US009470403B2

(12) United States Patent
Sterbenz

(10) Patent No.: US 9,470,403 B2
(45) Date of Patent: Oct. 18, 2016

(54) LAMP FRAME WITH AN INSERTABLE PANEL APPARATUS AND A METHOD THEREOF

(71) Applicant: Michael James Sterbenz, Poughkeepsie, NY (US)

(72) Inventor: Michael James Sterbenz, Poughkeepsie, NY (US)

( * ) Notice: Subject to any disclaimer, the term of this patent is extended or adjusted under 35 U.S.C. 154(b) by 204 days.

(21) Appl. No.: 14/553,997

(22) Filed: Nov. 25, 2014

(65) Prior Publication Data

US 2015/0146434 A1 May 28, 2015

Related U.S. Application Data

(60) Provisional application No. 61/909,975, filed on Nov. 27, 2013.

(51) Int. Cl.

| | |
|---|---|
| ***F21V 21/06*** | (2006.01) |
| ***F21V 33/00*** | (2006.01) |
| ***F21S 6/00*** | (2006.01) |
| *F21W 121/00* | (2006.01) |

(52) U.S. Cl.

CPC ..... *F21V 21/06* (2013.01); *F21S 6/002* (2013.01); *F21V 33/0032* (2013.01); *F21W 2121/00* (2013.01)

(58) Field of Classification Search

CPC .... F21S 6/002; F21V 21/06; F21V 33/0032; F21W 2121/00

See application file for complete search history.

(56) References Cited

U.S. PATENT DOCUMENTS

| | | | | |
|---|---|---|---|---|
| 5,598,652 | A | 2/1997 | Nurre | |
| 6,000,817 | A * | 12/1999 | Chan | F21V 1/06 362/311.06 |
| 6,022,122 | A | 2/2000 | Limardo | |
| 6,048,078 | A | 4/2000 | Wang | |
| 6,508,570 | B1 | 1/2003 | Tseng | |
| 6,997,581 | B1 | 2/2006 | Shelton et al. | |
| 2003/0210555 | A1 | 11/2003 | Cicero et al. | |
| 2009/0216658 | A1 | 8/2009 | Tuttle et al. | |
| 2014/0211458 | A1 | 7/2014 | Lai | |
| 2014/0268663 | A1 | 9/2014 | Yang | |
| 2014/0268814 | A1 | 9/2014 | Yang | |

* cited by examiner

*Primary Examiner* — Stephen F Husar

(74) *Attorney, Agent, or Firm* — Aziz M. Ahsan; Ahsan & Associates, PLLC

(57) ABSTRACT

The present invention relates generally to a lamp frame with an insertable panel apparatus and a method thereof. More particularly, the invention encompasses a lamp frame having at least one frame, and wherein the frame has at least one means to securely and releaseably hold and retain at least one insert-able and removable panel therein. The inventive frame can be used in conjunction with any lamp, such as, a table lamp, a decorative lamp, a floor lamp, a customizable lamp. The insertable/removable panel can be a flat panel, or a panel with at least one opening, and on one or more face can have an indicia, writing, art work, etc., thereon.

20 Claims, 3 Drawing Sheets

LAMP FRAME WITH AN INSERTABLE PANEL APPARATUS AND A METHOD THEREOF

CROSS-REFERENCE TO RELATED APPLICATION

The instant patent application claims priority to and the benefit of U.S. Provisional Patent Application Ser. No. 61/909,975, filed on Nov. 27, 2013, titled "Lamp Frame With An Insertable Panel," the entire disclosure of which provisional application is incorporated herein by reference.

FIELD OF THE INVENTION

The present invention relates generally to a lamp frame with an insertable panel apparatus and a method thereof. More particularly, the invention encompasses a lamp frame having at least one frame, and wherein the frame has at least one means to securely and releaseably hold and retain at least one insert-able and removable panel therein. The inventive frame can be used in conjunction with any lamp, such as, a table lamp, a decorative lamp, a floor lamp, a customizable lamp. The insertable/removable panel can be a flat panel, or a panel with at least one opening, and on one or more face can have an indicia, writing, art work, etc., thereon.

BACKGROUND INFORMATION

Lamps, and lamp frames have been used in the lamp industry for a variety of reasons, and they come in many shapes, sizes, and other physical features and attributes. Various attempts have been made to further improve on the lamp and related technologies, and that have resulted in varying outcomes.

U.S. Pat. No. 5,598,652 (David F. Nurre), the entire disclosure of which is incorporated herein by reference, discloses a lamp base comprising an external transparent sleeve and an interior, outwardly tensioning rigid or semi-rigid thin flexible sleeve or sheet which bears upon the interior of the external transparent sleeve due to outward tension. The rigid or semi-rigid thin flexible sleeve or sheet is capable of securing decorative materials such as wall paper or upholstery or items of specialized sentimental value such as photos or any other pliable that materials of special interest to the owner. The decorative materials may be easily and repeatedly changed as desired by the owner of the lamp.

U.S. Pat. No. 6,022,122 (Castro L. Limardo), the entire disclosure of which is incorporated herein by reference, discloses a decorative lamp for displaying a back lit image thereon including a case having a hole therethrough with spaced apart and generally transparent front and back panes provided in the hole. A decorative design is provided on the front pane. A light source is extended from the case into the hole between the front and back panes. A power source is provided in the case and electrically connected to the light source. A suspension tab is coupled to the case. An elongate flexible member is coupled to the suspension tab for suspending the case from a structure.

U.S. Pat. No. 6,048,078 (I-Hwa Wang), the entire disclosure of which is incorporated herein by reference, discloses a combined table lamp and clock assembly which includes a lamp unit and a clock unit. The lamp unit includes a lamp stand base, a lamp stand, and a lamp bulb holder. The lamp stand base has a top side formed with a cavity, and a bottom side adapted to be placed on a table top. The lamp stand extends uprightly from the lamp stand base, and has an upper end portion and a lower end portion that is mounted on the top side of the lamp stand base. The lamp bulb holder is mounted on the upper end portion of the lamp stand, and is adapted for mounting a lamp bulb thereon. The clock unit includes a clock base, an upright clock panel, and a clock mechanism. The clock base is received in the cavity in the top side of the lamp stand base, and is formed with an insert slot therethrough. The upright clock panel has a lower end formed with an insert portion that is inserted removably into the insert slot. The clock mechanism is mounted on the clock panel.

U.S. Pat. No. 6,508,570 (Jean-Nan Tseng), the entire disclosure of which is incorporated herein by reference, discloses a decorative lamp that has a base having two ends wherefrom a first arcuate rod and a second arcuate rod integrally and respectively extend to interact to each other. A first post is connected between a first free end of the first arcuate rod and one end of the base. A second post is connected between a first free end of the second arcuate rod and the other end of the base. A plurality of bulbs is assembled on the base, the first arcuate rod and the second arcuate.

U.S. Pat. No. 6,997,581 (Dairen Shelton, et al.), the entire disclosure of which is incorporated herein by reference, discloses a decorative lamp display panel assembly for attachment to out door wall/post lanterns, or like structure, such assembly having a removable display panel having a decorative picture and/or indicia thereon. A top frame member is releasably secured to the top edge of the display panel and a bottom frame member is releasably secured to the bottom edge of the display panel. A support arm assembly is connected to the top frame member at a front end, and to a clamp member at the rear end. The clamp member has finger members that can be bent outwardly so that they can be attached to different diameter structure on an outdoor lantern. The support arm assembly can be extended and retracted, and it can be adjusted to different vertical angles to vary the height of the top frame member with respect to the clamp member.

U.S. Patent Publication No. 2003/0210555 (Gregory C. Cicero, et al.), the entire disclosure of which is incorporated herein by reference, discloses a decorative lamp (10, 100) for producing a diffuse or scattered lighting. A container (12, 102, 116) includes a light transmissive portion (18). A light source (20, 104, 118, 120, 150) includes a housing (32, 122, 152) arranged inside the light transmissive container (12, 102). The housing (32, 122, 152) includes a battery compartment (52, 130, 162) electrically and mechanically adapted to receive at least one associated battery. At least one LED (36, 38, 126, 158) is disposed on a first side (34) of the housing (32, 122, 150) and cooperates with the container (12, 102) to emit diffuse or scattered light from the light transmissive portion (18). A fastening means (62, 134) is arranged on a second side (60) of the housing (32, 122). The fastening means (62, 134) is provided to fasten the housing (32, 122, 150) to an inner side (76) of the container (12, 102) wherein the at least one LED (36, 38, 126, 128, 158) illuminates the interior of the container (12, 102).

U.S. Patent Publication No. 2009/0216658 (Michael T. Tuttle, et al.), the entire disclosure of which is incorporated herein by reference, discloses a customer-customizable lamp which includes a vertical support post mounted to a base plate. The customer selects from five different heights of decorative blocks to be mounted on the post. Each selected block may be provided in any one of five selectable colors or four selectable simulated wood grains. The selection of blocks and finishes are made on a web page with an interactive representation of the customizable lamp being displayed as the design is being created by the customer. The remaining height on the support post to be filled with decorative blocks is displayed. Once the post is filled and the customer has selected finishes for each selected block, the lamp design can be finalized for delivery to the customer. The customer selectable blocks and colors/finishes permit several million permutations so that the customer can create a highly individualized decorative lamp.

U.S. Patent Publication No. 2014/0211458 (Wen-Cheng LAI), the entire disclosure of which is incorporated herein by reference, discloses a candle stand with faux flame, including a lamp stand, power supply, support frame, holder, flame decorative element light-emitting body, motor, driving element, first resistive magnet body, and at least a second resistive magnet body. The support frame is fixedly standing upon lamp stand; the flame decorative element is suspended at top of holder; the light-emitting body emits light towards flame decorative element. The power supply and motor are inside lamp stand for driving the driving element. The first resistive magnet body is disposed at lower end of flame decorative element. The second resistive magnet body is disposed on the driving element. When the motor drives the driving element, the second resistive magnet body moves close to or away from first resistive magnet body so as to sway flame decorative element. With projected light, the swaying flame decorative element emulates a flame.

U.S. Patent Publication No. 2014/0268663 (Chin-Sheng Yang), the entire disclosure of which is incorporated herein by reference, discloses a rotational game decorative device, including: a aquatic lamp main body, a magnet-driven element, a buoy and a bottom base. The magnetic-driven element and the buoy are disposed inside the aquatic lamp main body. The top and the bottom of the buoy are disposed with a plurality of rotational plates disposed with interval. The bottom base is fixedly engaged to the aquatic lamp main body with a magnetic rotational axis for correspondingly attaching to the magnet, driven element, and driven by a driving element to rotate. When the magnetic rotational axis rotates, the magnet-driven element also rotates because of attachment to the magnetic rotational axis so as to wave the fluid inside the aquatic lamp main body, which leading to pushing to rotational plats to rotate the buoy.

U.S. Patent Publication No. 2014/0268814 (Chin-Sheng Yang), the entire disclosure of which is incorporated herein by reference, discloses a customized signature decorative lamp, mainly containing: a shell, a base and a projection film. The shell is a light-transmittable three-dimensional shape, and has a downward opening. The base is disposed correspondingly at the bottom of the shell to seal the opening, and includes a light-emitting element corresponding to the inside of the shell. The projection film is disposed inside the shell and surrounds the light-emitting element. The projection film has customized signature pattern able for light to pass through. As such, when the light-emitting element projects light onto the projection film, the customized signature pattern can be projected onto the shade so that the lamp of the present invention can display personalized decoration.

This invention improves on the deficiencies of the prior art and provides an inventive lamp frame with a releaseably insertable panel apparatus and a method thereof.

PURPOSES AND SUMMARY OF THE INVENTION

The invention is a novel lamp frame with a releaseably insertable panel apparatus and a method thereof.

Therefore, one purpose of this invention is to provide a lamp frame with a releaseably insertable panel apparatus and a method thereof.

Another purpose of this invention is to provide a lamp with a frame having at least one means to securely engage with at least one insertable and a removable panel.

Yet another purpose of this invention is to provide a lamp with a frame, and where an insertable panel is releaseably and engageably secured inside the frame.

Therefore, in one aspect this invention comprises a lamp frame assembly apparatus, comprising;

(a) a lamp frame having a first leg, a second leg, a third leg, and a fourth leg, and wherein each leg is connected to other to substantially form a rectangular frame, said rectangular frame having a lower portion, an upper portion, an inner peripheral portion having at least one inner frame securing means, and an outer peripheral portion;

(b) a base having an upper base portion, a lower base portion, and a side base portion, and wherein a portion of said upper base portion is securely connect to said lower portion of said rectangular frame;

(c) a lamp holder having lamp holder base and bulb holder portion, wherein said upper portion of said rectangular flame is securely connected to said lamp holder base; and (d) at least one releaseably insertable panel having at least one peripheral engaging means, and wherein said at least one peripheral engaging means is releaseably and engageably secured to said at least one inner frame securing means.

In another aspect this invention comprises a lamp frame assembly apparatus, comprising;

(a) a lamp frame having a tubular structure having an outer peripheral wall and an inner peripheral wall, and wherein an opening is created by said inner peripheral wall, said inner peripheral wall having at least one frame engaging means;

(b) a base having an upper base portion, a lower base portion, and a side base portion;

(c) a lamp holder having a lamp holder base and a bulb holder portion;

(d) at least one lamp support, and wherein said lamp support is connected to one of said upper base portion of said base, a portion of said lamp frame, and a portion of said lamp holder; and (e) at least one releaseably insertable panel having at least one peripheral engaging means, and wherein said at least one peripheral engaging means is releaseably and engageably secured to said at least one frame engaging means.

BRIEF DESCRIPTION OF THE DRAWINGS

FIG. 3A, illustrates a front or back side view of an inventive lamp frame with an insertable panel according to a second embodiment of a lamp frame assembly invention, while

DETAILED DESCRIPTION

Figure 1:
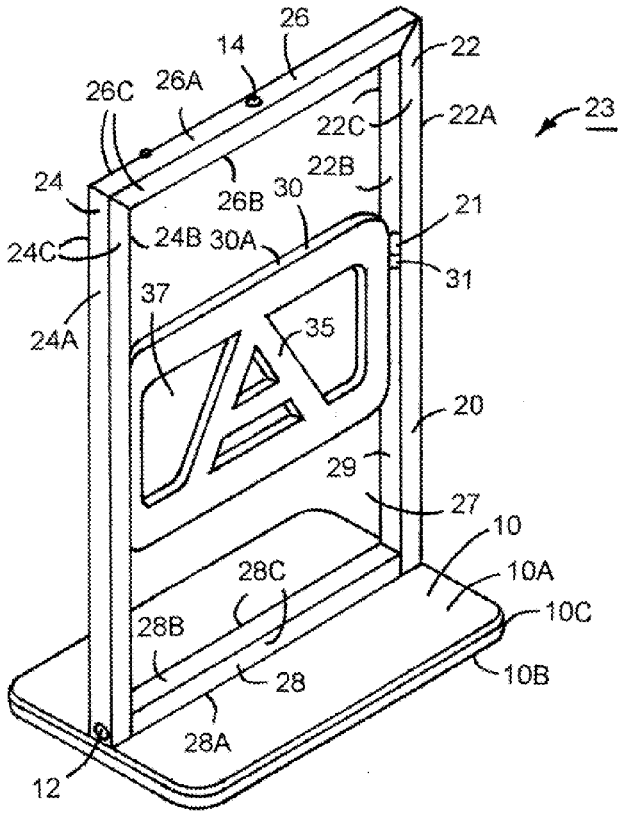
FIG. 1, illustrates a perspective view of an inventive lamp frame with an insertable panel according to a first embodiment of the invention.

The inventive lamp frame with an insertable panel apparatus and a method thereof will now be discussed with reference to FIGS. 1 through 8. Although the scope of the present invention is much broader than any particular embodiment, a detailed description of the preferred embodiment follows together with drawings. These drawings are for illustration purposes only and are not drawn to scale. Like numbers represent like features and components in the drawings.

The invention may best be further understood by reference to the ensuing detailed description when taken in conjunction with FIG. 1 through FIG. 8.

Figure 8:
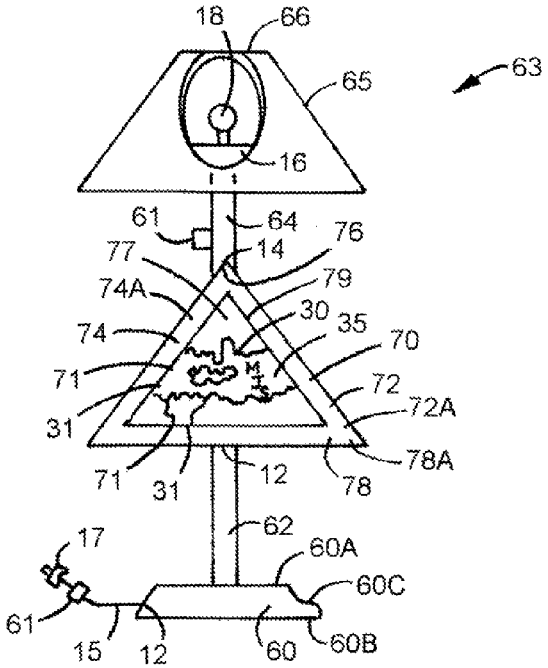
FIG. 8, illustrates a front or back side view of an inventive lamp frame with an insertable panel according to a seventh embodiment of the invention.

FIG. 1, illustrates a perspective view of an inventive lamp frame 20, with an insertable panel 30, according to a first embodiment of this lamp frame assembly invention 23. The lamp frame 20, comprises of a first or right side support or member 22, that is securely connected to a third or top side support or member 26, at one end of the member 26, while the other end of the member 26, is securely connected to a second or left side support or member 24, and wherein support members 22, 26, and 24, form substantially an inverted "U". The open ends of members 22, 24, could be secured to a base 10, or to fourth or bottom support or member 28, and thus forming a substantially a rectangular or a polygonal structure with at least one open area 27. The lamp frame assembly 23, has a base 10, having a top or upper base surface 10A, a bottom or lower base surface 10B, and a side or peripheral base surface 10C. For some applications, the open ends of members 22, 24, could be secured to the fourth or bottom member 28, and then in turn the bottom member 28, could be secured to the upper surface 10A, of the base 10. Each member 22, 24, 26, 28, has an outer surface or outer peripheral wall 22A, 24A, 26A. 28A, an inner surface or inner peripheral wall 22B, 24B, 26B, 28B, and a side surface or side wall 22C, 24C, 26C, 28C, respectively. Preferably, the top or third member 26, has at least one opening 14, preferably, on the outer peripheral wall 26A, for the passage of a first or an upper end of at least one electrical wiring 15, shown in FIG. 3A. Preferably, at least one of the member 22, 24, 28, has at least one opening 12, for the passage of a second or a lower end of the at least one electrical wiring 15, as shown in FIG. 3A. For some applications, the second or lower opening 12, could be on the upper surface 10A, bottom surface 10B, or side edge 10C, of the base 10, as shown in FIG. 8. At least one of the inner surface 22B, 24B, 26B, 28B, along the inner peripheral wall 29, of the frame 20, has at least one frame engaging means 21, to releaseably and securely engage with at least one panel engaging means 31, that are along the outer peripheral surface 30A, of the panel insert 30. It should be appreciated that the cross-sectional area of each member 22, 24, 26, 28, could be polygonal, rectangular, square, or combination thereof, to name a few. For the ease of understating, other related features, such as, lamp holder 16, bulb 18, shade 65, shade holder 66, have not been shown in all the Figures.

Figure 2:
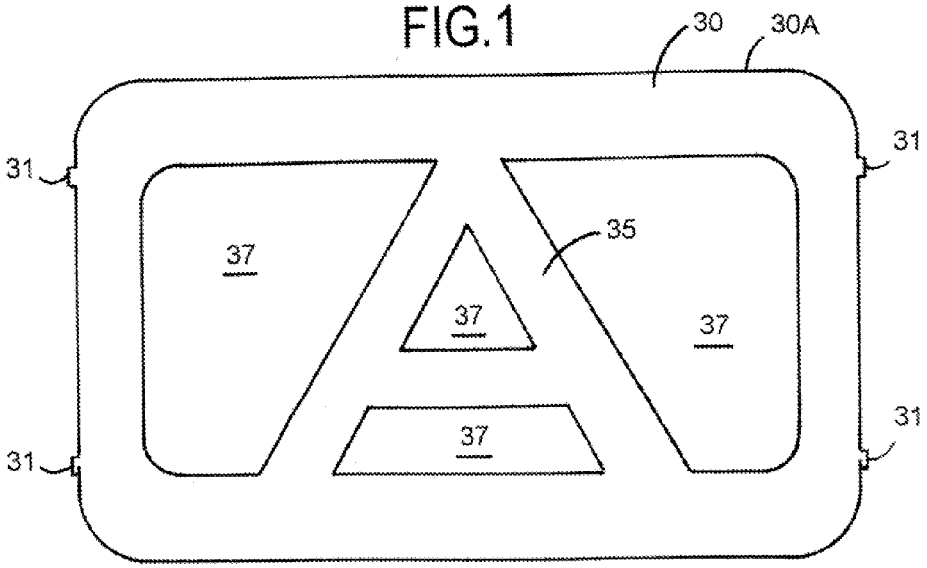
FIG. 2, illustrates a front or back view of the inventive releaseably insertable panel according to a first embodiment of the invention.

FIG. 2, illustrates a front or back view of the inventive releaseably insertable panel 30, according to a first embodiment of the invention 23. The releaseably insertable panel 30, has an outer peripheral wall or edge 30A, that has at least one male portion or tab or tongue or panel engaging means 31, that is associated with the outer peripheral wall or edge 30A, and which is used to releaseably and securely engage with the corresponding frame engageable means 21. The releaseably insertable panel 30, could have at least one feature 35. For some applications the releaseably insertable panel 30, could also have at least one hole or opening 37. The hole or opening 37, could be used to further define or enhance the visibility of the insertable panel 30, or any feature 35, thereon.

Figure 3C:
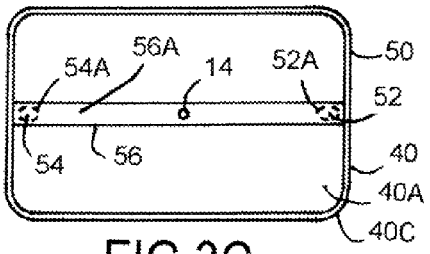
FIG. 3C is a top view.
Figure 3A:
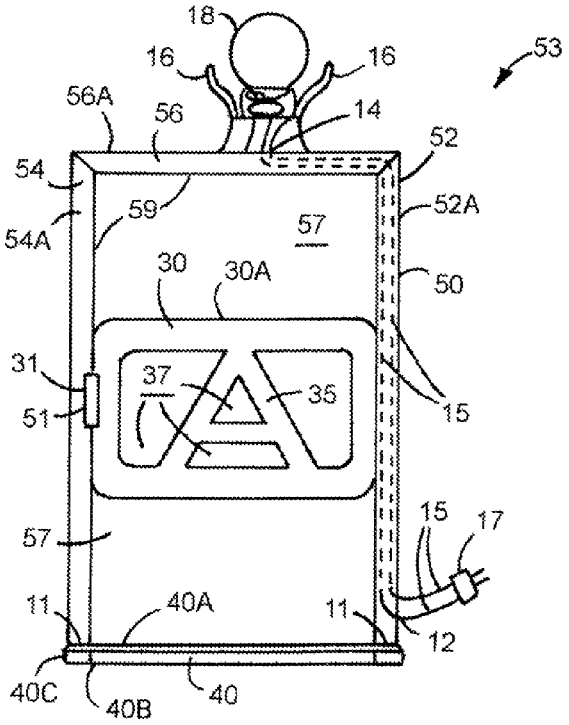
Figure 3D:
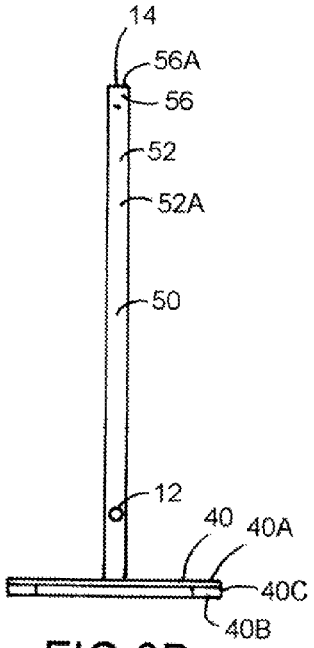
FIG. 3D, is a side view, of the inventive, lamp frame with an insertable panel as illustrated in FIG. 3A.
Figure 3B:
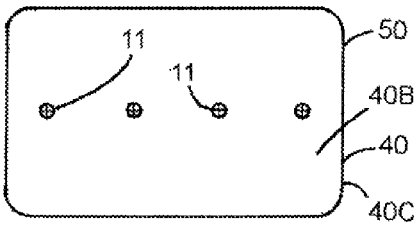
FIG. 3B, is a bottom view.

FIG. 3A, illustrates a front or back side view of the inventive lamp frame 50, with an insertable panel 30, according to a second embodiment of a lamp frame assembly invention 53, while FIG. 3B, is a bottom view, FIG. 3C is a top view, and FIG. 3D, is a side view. The inventive lamp frame assembly 53, comprises of a lamp frame 50, comprising of a first or right side support or member 52, that is securely connected to a third or top side support or member 56, at one end of the member 56, while the other end of the member 56, is securely connected to a second or left side support or member 54, and wherein support members 52, 56, and 54, form substantially an inverted "U". The open ends of members 52, 54, are secured to a base 40, and thus forming substantially a rectangular or a polygonal structure with at least one open area 57. The lamp frame assembly 53, has a base 40, having a top or upper base surface 40A, a bottom or lower base surface 40B, and a side or peripheral base surface 40C. For some applications, the open ends of members 52, 54, could be secured to the fourth or bottom member 28, and then in turn the bottom member 28, could be secured to the upper surface 40A, of the base 40. Each member 52, 54, 56, has a surface or peripheral wall 52A, 54A, 56A, respectively. Preferably, the top or third member 56, has at least one opening 14, preferably, on the upper portion of the peripheral wall or surface 56A, for the passage of a first or an upper end of at least one electrical wiring 15, that is electrically connected to at least one light bulb 18. The at least one light bulb 18, is preferably held inside a lamp holder or fixture 16, and wherein the lamp holder 16, is securely secured to the top member 56, and preferably, along the peripheral surface 56A. Preferably, at least one of the member 52, 54, has at least one opening 12, for the passage of a second or a lower end of the at least one electrical wiring 15, that is electrically connect to an electrical plug, or connector 17. For some applications, the second or lower opening 12, could be on the upper surface 40A, bottom surface 40B, or side edge 40C, of the base 40, as shown in FIG. 8. At least one of the inner portion of the peripheral surface 52A, 54A, 56A, along the inner peripheral wall 59, of the frame 50, has at least one frame engaging means 51, to releaseably and securely engage with at least one panel engaging means 31, that are along the outer peripheral surface 30A, of the panel insert 30. It should be appreciated that the cross-sectional area of each member 52, 54, 56, could be circular or elliptical, or combination thereof, to name a few. At least one securing means 11, could be used to secure the lower surface 40B, of the base 40, to the upper or top surface 40A, of the base 40. At least one of the at least one securing means 11, could also be used to secure the base 40, to the bottom or lower or open end of the lamp frame or support member 52, and/or the lamp frame or support member 54. For the ease of understating, other related, features, such as, shade 65, shade holder 66, have not been shown in all the Figures.

Figure 4:
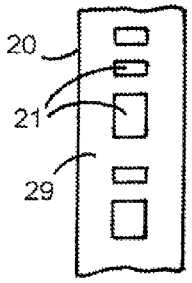
FIG. 4, illustrates an inner side view of an inventive frame according to a third embodiment of the invention.

FIG. 4, illustrates an inner side view of the inventive frame 20, according to a third embodiment of the invention. The frame 20, has a surface or wall 29, having at least one opening or hole or female portion 21, for the secure and releaseable insertion of the tab 31, of the insertable panel 30, into the opening 21, and be releaseably and engageably held therein. For some applications the feature 21, could be a tab 21, a tongue 21, a male portion 21, a female portion 21, a blind hole 21, a channel lock 21, to name a few.

Figure 5:
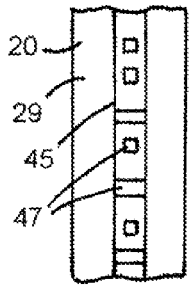
FIG. 5, illustrates an inner side view of an inventive frame according to a fourth embodiment of the invention.

FIG. 5, illustrates an inner side view of the inventive frame 20, according to a fourth embodiment of the invention. The frame 20, has a surface or wall 29, having at least one channel 45, having at least one channel lock or tab or teeth or male portion 47, for the secure and releaseable insertion or engagement of the tab 31, or opening 33, of the insertable panel 30, into the channel 45, and be releaseably and engageably held therein using at least one channel lock 47.

Figure 6:
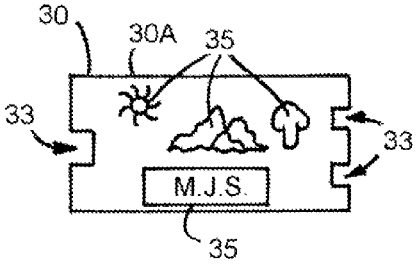
FIG. 6, illustrates a front or back view of an inventive releaseably insertable panel according to a fifth embodiment of the invention.

FIG. 6, illustrates a front or back view of the inventive releaseably insertable panel 30, according to a fifth embodiment of the invention. The releaseably insertable panel 30, has a peripheral edge 30A, having at least one hole or opening or female portion 33, and which portion 33, of the insertable panel 30, is inserted into the channel 45, and be releaseably and engageably held therein using at least one channel lock 47.

Figure 7:
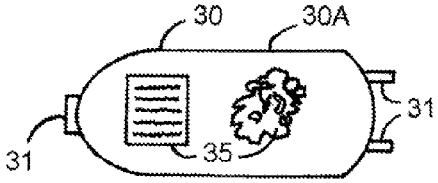
FIG. 7, illustrates a front or back view of an inventive releaseably insertable panel according to a sixth embodiment of the invention.

FIG. 7, illustrates a front or back view of the inventive releaseably insertable panel 30, according to a sixth embodiment of the invention. The releaseably insertable panel 30, has a peripheral edge 30A, having at least one tab or tongue or male portion 31, and which portion 31, of the insertable panel 30, is inserted into an opening or hole 21, and be releaseably and engageably held therein using at least one hole or opening 21.

FIG. 8, illustrates a cut-away side view of the inventive lamp frame 70, with an insertable panel 30, according, to a seventh embodiment of the lamp frame assembly invention 63. The inventive lamp frame assembly 63, comprises of a lamp frame 70, comprising, of a first or right side support or member 72, that is securely connected to a second or left side support or member 74, at a location 76, and wherein support members 72, and 74, form substantially an inverted "V" or a triangular type shape. The open ends of members 72, 74, can then be secured to a third member 78, and thus forming substantially a triangular or a polygonal structure with at least one open area 77. The lamp frame assembly 63, has a base 60, having a top or upper base surface 60A, a bottom or lower base surface 60B, and a side or peripheral base surface 60C. At location 76, the lamp frame 70, could then be securely connected to the lower end or a top or upper lamp support 64, while the upper to top end of the lamp support 64, could be secured to the bulb holder 16, having at least one bulb 18. A shade holder 66, having a shade 65, could also be secured to either the bulb holder 16, or the upper lamp support 64, or to the lamp frame 70, at location 76. The lamp frame assembly 63, could also have at least one lower lamp support 62, and wherein the lower end of the lower lamp support 62, could be secured to the base 60, such as, to the upper surface 60A, of the base 60, while the upper end of the lower lamp support 62, could be securely connected to the lower member 78, such as, to the peripheral surface 78A, of the lower member 78. Each member 72, 74, 78, has a surface or peripheral wall 72A, 74A. 78A, respectively. Preferably, the location 76, where the first member 72, and second member 74, meet has at least one opening 14, for the passage of a first or an upper end of at least one electrical wiring 15, that is electrically connected to at least one light bulb 18. The at least one light bulb 18, is preferably held inside a lamp holder or fixture 16, and wherein the lamp holder 16, is securely secured to the upper of top lamp holder 64. Preferably, at least one of the member 72, 74, 78, has at least one opening 12, for the passage of a second or a lower end of the at least one electrical wiring 15, that is electrically connected to an electrical plug or connector 17. For some applications, the second or lower opening 12, could be on the upper surface 60A, bottom surface 60B, or side edge 60C, of the base 60. At least one of the inner portion of the peripheral surface 72A, 74A, 78A, along the inner peripheral wall 79, of the frame 70, has at least one frame engaging means 71, to releaseably and securely engage with at least one panel engaging means 31, that are along the outer peripheral surface 30A, of the panel insert 30. It should be appreciated that the cross-sectional area of each member 72, 74, 78, could be circular, or elliptical, or polygonal, or combination thereof, to name a few. For some applications one could also have at least one electrical control device 61, such as, an ON/OFF button 61.

Thus, the invention in one aspect is a lamp frame 20, 50, 70, with an insertable/removeable panel 30, and more specifically a lamp frame 20, 50, 70, that has at least one open area 27, 57, 77, for the insertion of at least one removeably engageable panel 30. The panel 30, is preferably a flat panel 30, having at least one means 31, 33, to removeably engageably be secured to an inner frame portion 21, 47, 51, 71, of the lamp frame 20, 50, 70. The lamp frame 20, 50, 70, has at least one opening 12, 14, for the entrance of at least one electrical wire 15, and at least one opening 12, 14, for the exit of said at least one electrical wire 15. The lamp frame 20, 50, 70, also has at least one light/bulb holder assembly 16, for the mounting of at least one light bulb 18. The lamp bulb 18, can be activated by at least one electronic means 17, 61, such as, an ON/OFF switch 61, a three-way control switch 61, a remote transmitting device 61, and combinations thereof, to name a few. An AC or DC current 17, can be used to activate the lamp bulb 18. The base 10, 40, 60, is secured to the lamp frame 20, 50, 70, by at least one securing means 11, such as, for example, a screw 11, a bolt 11, a weld 11, and combinations thereof, to name a few. It should be appreciated that the base 10, 40, 60,/frame 20, 50, 70, can have the same color or a different color combination, and which can be easily changed by the customer. For some applications it is preferred that the base 10, 40, 60,/frame 20, 50, 70, and other components are modular, so as to make it easier to store, and/or ship/transport, as it would take up much less space in either in storage or in a shipping container.

The releaseably insertable panel 30, has at least one engaging means 31, 33, to securely and releaseably engage with the engaging means 21, 47, 51, 71, of the lamp frame 20, 50, 70, and wherein the at least one engaging means 31, 33, is selected from a group comprising of a tab, a tongue, a male portion, a female portion, a blind hole, and combinations thereof, to name a few.

The lamp frame 20, 50, 70, also has at least one engaging means 21, 47, 51, 71, to securely and releaseably engage with the engaging means 31, 33, of the at least one releaseably insertable panel 30, and wherein the at least one engaging means 21, 47, 51, 71, is selected from a group comprising of a tab, a tongue, a male portion, a female portion, a blind hole, a channel lock, and combinations thereof, to name a few.

The at least one releaseably insertable panel 30, could be selected from a group comprising, a flat panel 30, an embossed panel 30, a raised panel 30, and combinations thereof, to name a few.

The releaseably insertable panel 30, could have at least one feature 35, and wherein the feature 35, could be selected from a group comprising, a statement 35, an image 35, a raised feature 35, a relief feature 35, a scenery 35, a logo 35, an abstract art 35, and combinations thereof, to name a few.

The cross-sectional area for the inventive member 22, 24, 26, 28, 52, 54, 56, 72, 74, 78, can be selected from a group comprising a triangle, a square, a rectangle, a circle, an oval, a polygonal shape, a cylindrical shape, and combinations thereof, to name a few.

The substantial shape of the face of the engageably insertable and removeable panel 30, can be selected from a group comprising a triangle, a square, a rectangle, a circle, an oval, a polygonal shape, a cylindrical shape, an odd shape, and combinations thereof, to name a few.

The material for the engageably insertable and removeable panel 30, and/or the lamp frame 20, 50, 70, can be selected from a group comprising, glass, fiberglass, polymeric material, metal, aluminum, plastic, stainless steel, a composite material, and combinations thereof, to name a few.

Thus, the present invention is not limited to the embodiments described herein and the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

Still further, while certain embodiments of the inventions have been described, these embodiments have been presented by way of example only, and are not intended to limit the scope of the inventions. Indeed, the novel methods and apparatus described herein may be embodied in a variety of other forms; furthermore, various omissions, substitutions and changes in the form of the methods and apparatus described herein may be made without departing from the spirit of the inventions.

It should be further understood that throughout the specification and claims several terms have been used and they take the meanings explicitly associated herein, unless the context clearly dictates otherwise. For example, the phrase "in one embodiment" as used herein does not necessarily refer to the same embodiment, though it may. Additionally, the phrase "in another embodiment" as used herein does not necessarily refer to a different embodiment, although it may. Thus, various embodiments of the invention may be readily combined, without departing from the scope or spirit of the invention.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A lamp frame assembly apparatus, comprising;

(a) a lamp frame having a first leg, a second leg, a third leg, and a fourth leg, and wherein each leg is connected to other to substantially form a rectangular frame, said rectangular frame having a lower portion, an upper portion, an inner peripheral portion having at least one inner frame securing means, and an outer peripheral portion;

(b) a base having an upper base portion, a lower base portion, and a side base portion, and wherein a portion of said upper base portion is securely connect to said lower portion of said rectangular frame;

(c) a lamp holder having lamp holder base and bulb holder portion, wherein said upper portion of said rectangular frame is securely connected to said lamp holder base; and (d) at least one releaseably insertable panel having at least one peripheral engaging means, and wherein said at least one peripheral engaging means is releaseably and engageably secured to said at least one inner frame securing means.

2. The lamp frame assembly apparatus of claim 1, wherein said at least one peripheral engaging means is selected from a group consisting of a tab, a tongue, a male portion, a female portion, a blind hole, and combinations thereof.

3. The lamp frame assembly apparatus of claim 1, wherein material for said at least one releaseably insertable panel is selected from a group consisting of glass, fiberglass, polymeric material, metal, aluminum, plastic, stainless steel, a composite material, and combinations thereof.

4. The lamp frame assembly apparatus of claim 1, wherein said at least one releaseably insertable panel is selected from a group consisting of a flat panel, an embossed panel, a raised panel, and combinations thereof.

5. The lamp frame assembly apparatus of claim 1, wherein said at least one releaseably insertable panel has at least one feature, and wherein said feature is selected from a group consisting of a statement, an image, a raised feature, a relief feature, a scenery, a logo, an abstract art, and combinations thereof.

6. The lamp frame assembly apparatus of claim 1, wherein said at least one inner frame securing means is selected from a group consisting of a tab, a tongue, a male portion, a female portion, a blind hole, a channel lock, and combinations thereof.

7. The lamp frame assembly apparatus of claim 1, wherein a cross-sectional area for at least one of said leg is selected from a group consisting of a triangle, a square, a rectangle, a circle, an oval, a polygonal shape, a cylindrical shape, and combinations thereof.

8. The lamp frame assembly apparatus of claim 1, wherein at least one lamp shade is secured to one of said lamp frame, lamp holder, and a lamp support.

9. The lamp frame assembly apparatus of claim 1, wherein at least one lamp bulb is secured to said bulb holder portion, and wherein said at least one lamp bulb is activated by at least one electronic means, and wherein said at least one electronic means is selected from a group consisting of an ON/OFF switch, a three-way control switch, a remote transmitting device, and combinations thereof.

10. The lamp frame assembly apparatus of claim 1, wherein said base is secured to said lamp frame by at least one means, and wherein said at least one means is selected from a group consisting of a screw, a bolt, a weld, and combinations thereof.

11. A lamp frame assembly apparatus, comprising;

(a) a lamp frame having a tubular structure having an outer peripheral wall and an inner peripheral wall, and wherein an opening is created by said inner peripheral wall, said inner peripheral wall having at least one frame engaging means;

(b) a base having an upper base portion, a lower base portion, and a side base portion;

(c) a lamp holder having a lamp holder base and a bulb holder portion;

(d) at least one lamp support, and wherein said lamp support is connected to one of said upper base portion of said base, a portion of said lamp frame, and a portion of said lamp holder; and (e) at least one releaseably insertable panel having at least one peripheral engaging means, and wherein said at, least one peripheral engaging means is releaseably and engageably secured to said at least one frame engaging means.

12. The lamp frame assembly apparatus of claim 11, wherein said at least one peripheral engaging means is selected from a group consisting of a tab, a tongue, a male portion, a female, portion, a blind hole, and combinations thereof.

13. The lamp frame assembly apparatus of claim 11, wherein material for said at least one releaseably insertable panel is selected from a group consisting of glass, fiberglass, polymeric material, metal, aluminum, plastic, stainless steel, a composite material, and combinations thereof.

14. The lamp frame assembly apparatus of claim 11, wherein said at least one releaseably insertable panel is selected from a group consisting of a flat panel, an embossed panel, a raised panel, and combinations thereof.

15. The lamp frame assembly apparatus of claim 11, wherein said at least one releaseably insertable panel has at least one feature, and wherein said feature is selected from a group consisting of a statement, an image, a raised feature, a relief feature, a scenery, a logo, an abstract art, and combinations thereof.

16. The lamp frame assembly apparatus of claim 11, wherein said at least one frame engaging means is selected from a group consisting of a tab, a tongue, a male portion, a female portion, a blind hole, a channel lock, and combinations thereof.

17. The lamp frame assembly apparatus of claim 11, wherein a cross-sectional area for said leg is selected from a group consisting of a triangle, a square, a rectangle, a circle, an oval, a polygonal shape, a cylindrical shape, and combinations thereof.

18. The lamp frame assembly apparatus of claim 11, wherein at least one lamp shade is secured to one of said lamp frame, lamp holder, and lamp support.

19. The lamp frame assembly apparatus of claim 11, wherein at least one lamp bulb is secured to said bulb holder portion, and wherein said at least one lamp bulb is activated by at least one electronic means, and wherein said at least one electronic means is selected from a group consisting of an ON/OFF switch, a three-way control switch, a remote transmitting device, and combinations thereof.

20. The lamp frame assembly apparatus of claim 11, wherein said base is secured to said lamp frame by at least one means, and wherein said at least one means is selected from a group consisting of a screw, a bolt, a weld, and combinations thereof.

* * * * *